US011476072B2

(12) United States Patent
Patwardhan

(10) Patent No.: US 11,476,072 B2
(45) Date of Patent: Oct. 18, 2022

(54) CIRCUIT INTERRUPTER

(71) Applicant: Eaton Intelligent Power Limited, Dublin (IE)

(72) Inventor: Sujit Patwardhan, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 30 days.

(21) Appl. No.: 17/136,554

(22) Filed: Dec. 29, 2020

(65) Prior Publication Data

US 2022/0208497 A1 Jun. 30, 2022

(51) Int. Cl.

| | |
|---|---|
| ***H01H 71/10*** | (2006.01) |
| ***H01H 3/38*** | (2006.01) |
| ***H01H 71/02*** | (2006.01) |

(52) U.S. Cl.
CPC ..... *H01H 71/1009* (2013.01); *H01H 3/38* (2013.01); *H01H 71/02* (2013.01); *H01H 2235/01* (2013.01)

(58) Field of Classification Search
CPC ..... H01H 71/1009; H01H 3/38; H01H 71/02; H01H 3/32; H01H 3/46; H01H 23/00; H01H 23/12
USPC ..... 200/293, 400, 401, 500, 553, 557, 335, 200/337, 339
See application file for complete search history.

(56) References Cited

U.S. PATENT DOCUMENTS

| | | | |
|---|---|---|---|
| 8,975,990 | B2 | 3/2015 | Godesa |
| 9,595,410 | B2 | 3/2017 | Watford |
| 10,366,853 | B1 | 7/2019 | Candelora et al. |
| 2004/0090293 | A1 * | 5/2004 | Castonguay ..... H01H 73/045 335/172 |

* cited by examiner

*Primary Examiner* — Edwin A. Leon
*Assistant Examiner* — Iman Malakooti
(74) *Attorney, Agent, or Firm* — Eckert Seamans Cherin & Mellott, LLC

(57) ABSTRACT

A circuit interrupter includes a handle, an operating linkage, and a spring that are situated on a housing, with the spring extending between the handle and the operating linkage. The circuit interrupter is movable among an ON position, an OFF position, and a TRIP position, and the operating linkage includes a contact arm that is pivotable with respect to the housing to move a movable contact between an OPEN position and a CLOSED position with respect to a stationary contact. The handle has a toggle point, and when the spring is situated at a first side of the toggle point, the spring biases the contact arm to the ON position. When the spring is situated at a second side of the toggle point, the spring biases the contact arm to the OFF position or the TRIP position.

20 Claims, 4 Drawing Sheets

CIRCUIT INTERRUPTER

BACKGROUND

Field

The disclosed concept relates generally to circuit interrupters and, more particularly, to a circuit interrupter having a spring that moves across a toggle point to switch the circuit interrupted among its various states.

Background Information

Numerous types of circuit interruption devices are known in the relevant art. Circuit interruption devices, such as circuit interrupters, circuit breakers, and the like, are typically electrically connected with a protected portion of a circuit and are operable to cease the flow of current in the protected portion of the circuit in certain overcurrent conditions, under-voltage conditions, fault conditions, and other conditions. While circuit interrupters have been generally effective for their intended purposes, they have not been without limitation.

For instance, many known circuit interrupters have a cam-based mechanism which can include extensive linkages and which also requires extensive forces in order to move such circuit interrupters among their various positions, which can include an OFF position, an ON position, and a TRIP position. Such cam-based systems have also been shown to be unreliable on occasion. Improvements thus would be desirable.

SUMMARY

These needs and others are met by embodiments of the invention, which are directed to an improved circuit interrupter.

As one aspect of the disclosed and claimed concept, an improved circuit interrupter includes a handle, an operating linkage, and a spring that are situated on a housing, with the spring extending between the handle and the operating linkage. The circuit interrupter is movable among an ON position, an OFF position, and a TRIP position, and the operating linkage includes a contact arm that is pivotable with respect to the housing to move a movable contact between an OPEN position and a CLOSED position with respect to a stationary contact. The handle has a toggle point, and when the spring is situated at a first side of the toggle point, the spring biases the contact arm to the ON position. When the spring is situated at a second side of the toggle point, the spring biases the contact arm to the OFF position or the TRIP position.

By providing the spring to extend between the handle and the operating linkage, the velocity of the contact arm is advantageously independent of the velocity of the handle. The use of a spring instead of links and cams also advantageously reduces mass and inertia, and permits faster contact movement. This also advantageously reduces cost. When rotating a previous handle to close a set of contacts, forces needed to be applied across the entire rotation of the handle. However, with the disclosed and claimed concept, the forces applied to the handle advantageously cause the spring to stretch in tension while the moving contact arm initially remains substantially stationary. Once the spring passes the toggle point, the potential energy of the spring is converted to kinetic energy that rapidly moves the contact arm from the OPEN position to the CLOSED position. As such, when moving the handle of the inventive circuit interrupter from the OFF position to the ON position, force needs to be applied during only a first portion of the rotational distance traversed by the handle since the spring will effectively pull the handle the remaining second rotational distance once the spring has passed the toggle point.

Accordingly, an aspect of the disclosed and claimed concept is to provide an improved circuit interrupter, the general nature which can be stated as including a housing, a stationary contact situated on the housing, a movable contact, a mechanism that can be generally stated as including a handle, an operating linkage, and a spring, the mechanism being movable among an OFF position, an ON position, and a TRIP position, the handle being situated on the housing and being pivotable with respect to the housing when the mechanism is moved among the OFF position, the ON position, and the TRIP position, the operating linkage being situated on the housing and can be generally stated as including a contact arm, the movable contact being disposed on the contact arm, the contact arm being pivotable with respect to the housing between a CLOSED position wherein the stationary contact and the movable contact are engaged with one another and an OPEN position wherein the stationary contact and the movable contact are spaced from one another, and the spring extending between the handle and the operating linkage, the spring being structured to bias the contact arm from the OPEN position to the CLOSED position when the mechanism moves from the OFF position to the ON position.

BRIEF DESCRIPTION OF THE DRAWINGS

A full understanding of the disclosed concept can be gained from the following Description when read in conjunction with the accompanying drawings in which.

DESCRIPTION OF THE PREFERRED EMBODIMENTS

Figure 1:
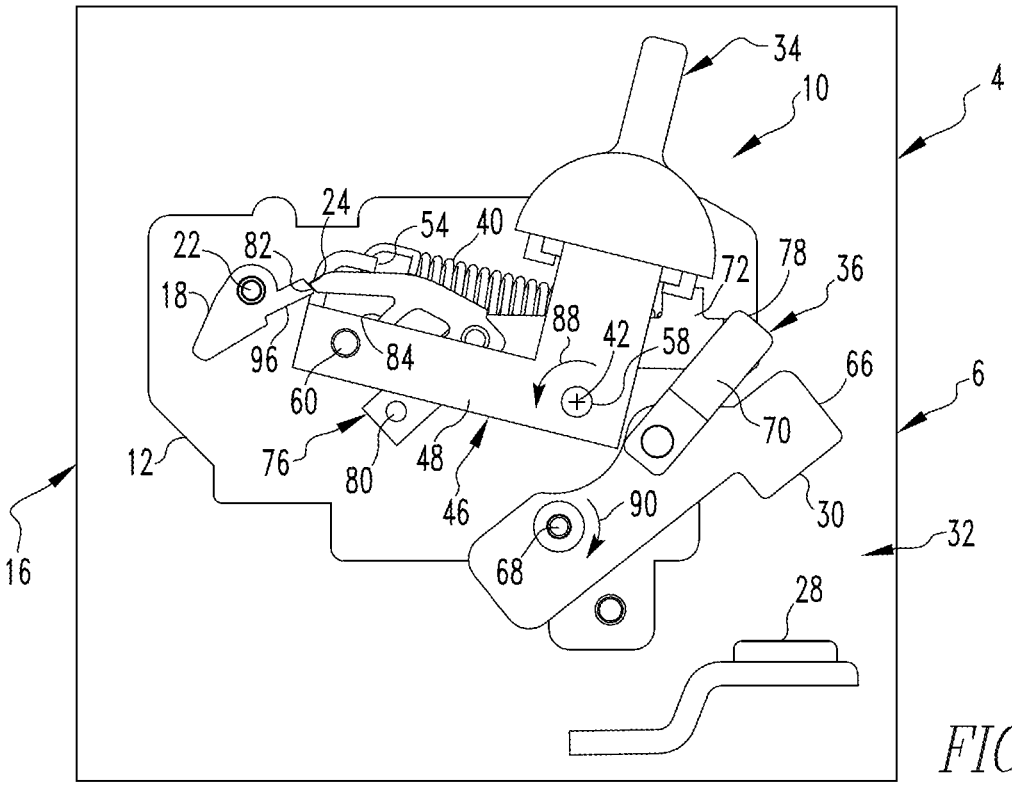
FIG. 1 is a schematic view of an improved circuit interrupter in accordance with the disclosed and claimed concept in an OFF position.

An improved circuit interrupter 4 in accordance with the disclosed and claimed concept is depicted generally in FIGS. 1-4. The circuit interrupter 4 can be said to include a housing 6 upon which is situated a mechanism 10 that is movable among an OFF position such as is depicted generally in FIGS. 1 and 5, an ON position such as is depicted generally in FIG. 2, and a trip position such as is depicted generally in FIGS. 3 and 6. The circuit interrupter 4 is structured to be connected with a protected portion of an electrical circuit and is operable to interrupt current in the protected portion of the circuit in certain predefined circumstances.

The housing 6 can be said to include a pair of plates 12 that are parallel with one another and are situated at opposite sides of the mechanism 10, it being noted that only one of the plates 12 is depicted in the accompanying drawings for reasons of clarity of disclosure. The mechanism 10 is movably disposed on the pair of plates 12. The housing 6 further includes a molded case 16 upon which the plates 12 are situated.

Figure 2:
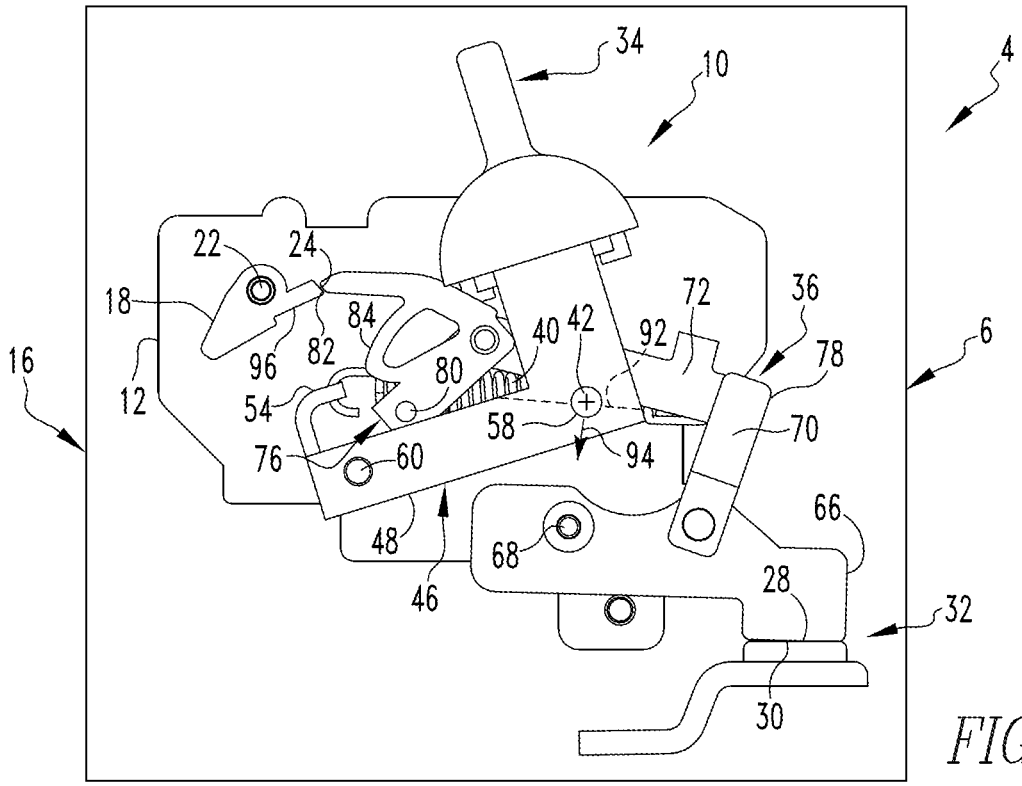
FIG. 2 is a view similar to FIG. 1, except depicting the circuit interrupter in an ON position.
Figure 3:
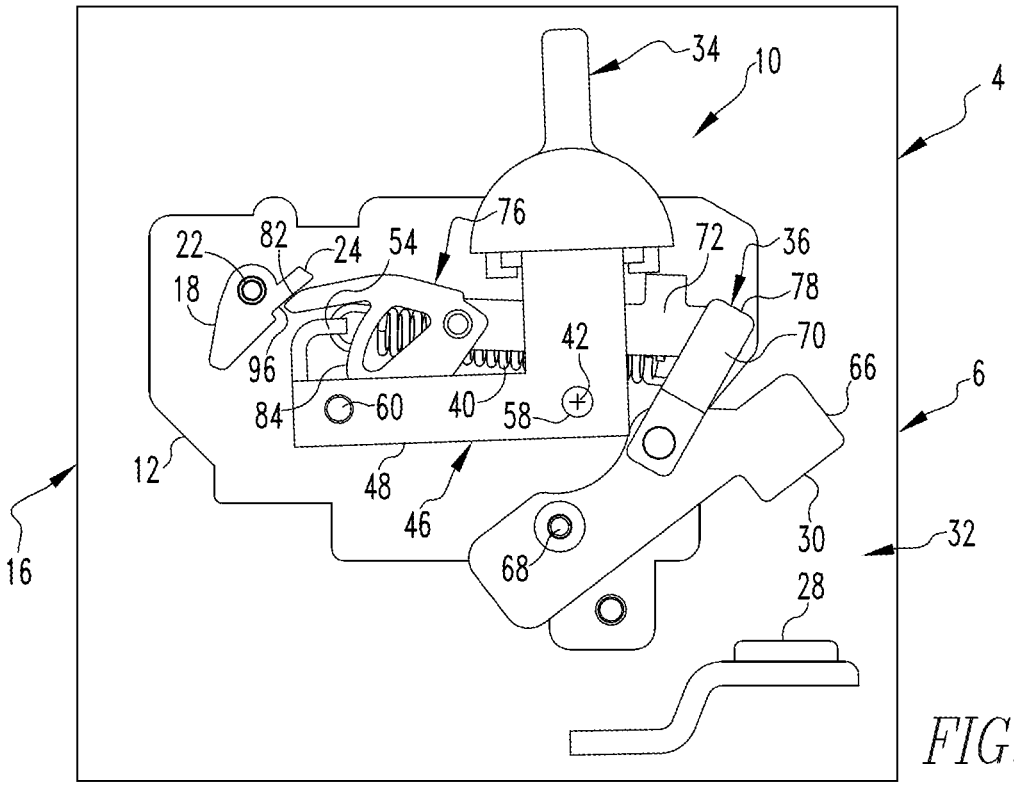
FIG. 3 is a view similar to FIG. 1, except depicting the circuit interrupter in a TRIP position.
Figure 4:
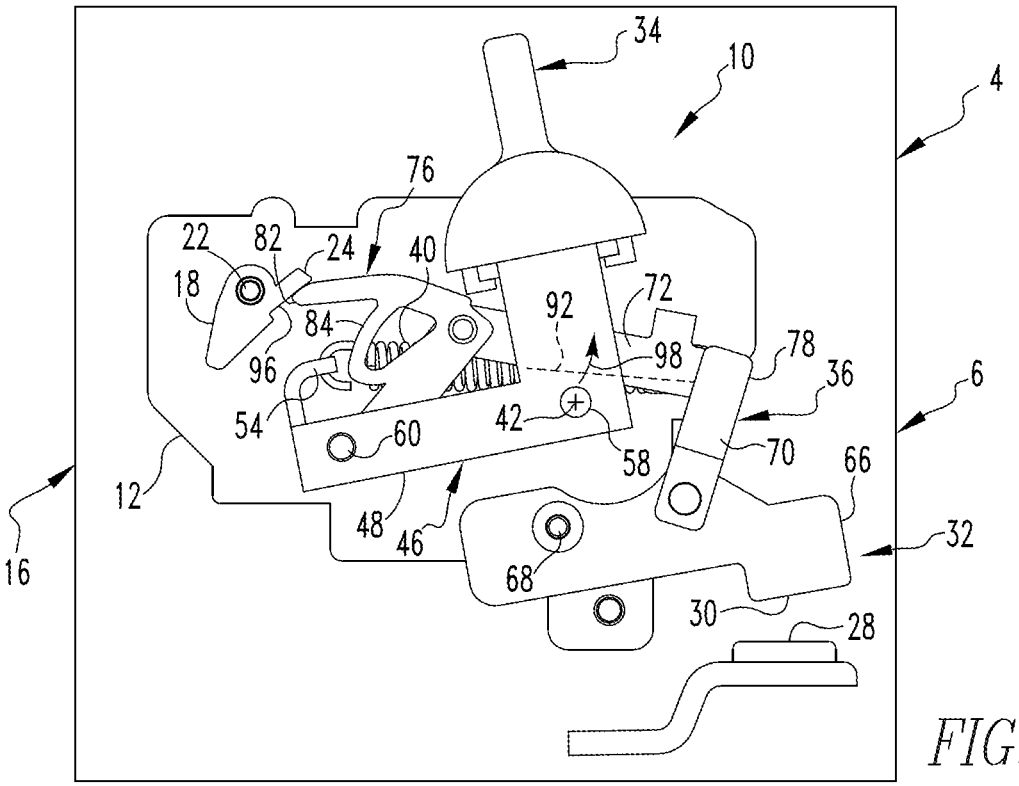
FIG. 4 is a view similar to FIG. 1, except depicting the circuit interrupter in an intermediate position between the ON position and the TRIP position during a trip operation.
Figure 5:
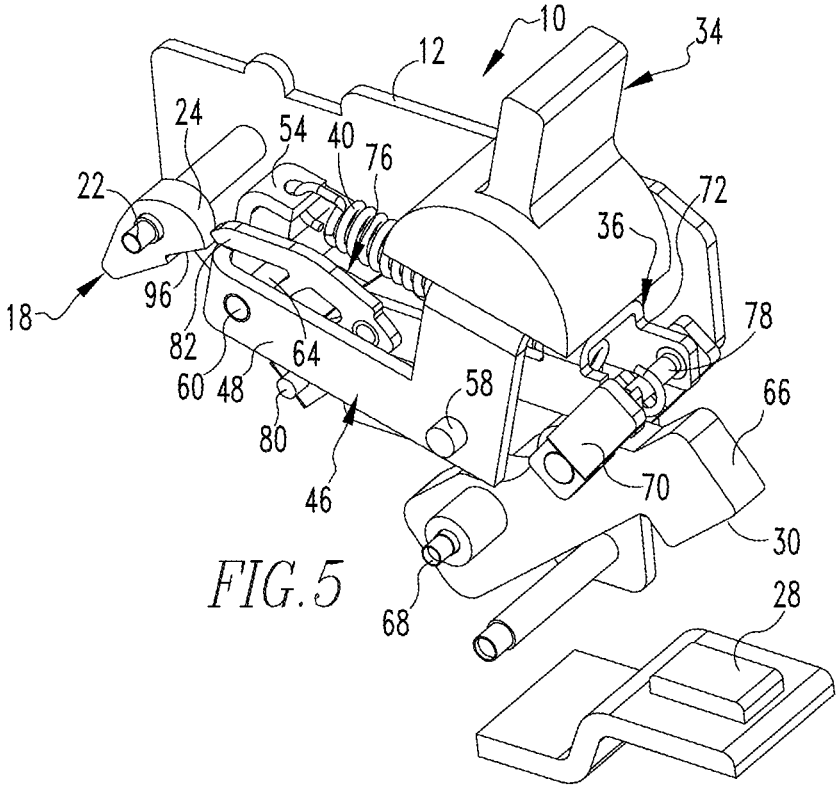
FIG. 5 is a perspective view of a mechanism of the circuit interrupter in the OFF position.
Figure 6:
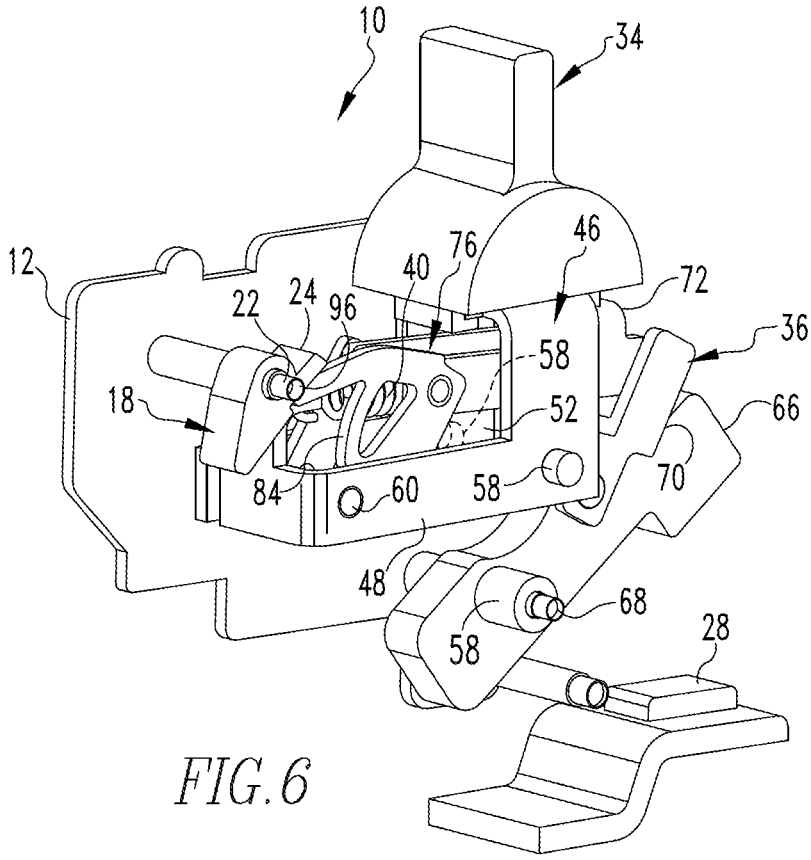
FIG. 6 is a perspective view of the mechanism of FIG. 5 in the TRIP position.

The circuit interrupter 4 further can be said to include a latch 18 that is affixed to a shaft 22, with the shaft 22 of being pivotable with respect to the housing 6 in order to move the latch 18 between a first position such as is depicted generally in FIGS. 1, 2, and 5 and a second position such as is depicted generally in FIGS. 3-4 and 6-7. The latch 18 includes a latch surface 24 that is engageable by a portion of the mechanism 10 as is set forth in greater detail elsewhere herein.

The circuit interrupter 4 can further be said to include a stationary contact 28 that is affixed to the housing 6 and to further include a movable contact 30 that is movably situated on the housing 6. The stationary contact 28 and the movable contact 30 can be said to together form a set of separable contacts 32 that are movable between an OPEN position, such as is depicted generally in FIGS. 1, 3-4, and 5-7, and a CLOSED position, such as is depicted generally in FIG. 2. As can be understood, the set of separable contacts 32 in the CLOSED position permit current to flow through the protected portion of the circuit whereas current is interrupted from flowing through the protected portion of the circuit when the set of separable contacts 32 are in the OPEN position.

The mechanism 10 can be said to include a handle 34, an operating linkage 36, and a spring 40. The spring 40 extends between the handle 34 and the operating linkage 36 and provides the operational connection between the handle 34 and the operating linkage 36.

The handle 34 is pivotably situated on the housing 6. The mechanism 10 can be said to include a toggle point 42 that, in the depicted exemplary embodiment, is also the pivot point of the handle 34 with respect to the housing 6. The handle 34 can be said to include a base 46 that includes, a first portion 48 and a second portion 52 that are plate-like and that extend substantially parallel with one another. The base 46 further includes a tang before that protrudes from the first and second portions 48 and 52 and to which the spring 40 is connected. The first and second portions 48 and 52 each include a boss 58 that protrudes therefrom and which is pivotably received in a corresponding hole formed in a corresponding plate 12. The pivoting movement of the bosses 58 in the holes formed in the plates 12 permits the handle 34 to pivot with respect to the housing 6. The handle 34 further includes a support 60 that is affixed to and extends between the first and second portions 48 and 52 and is in the exemplary form of a cylindrical pin. The handle 34 further includes a roller 64 (FIG. 7) that is of an annular cross-section and that is pivotably situated on the support 60. It thus can be understood that while the support 60 is stationary with respect to the handle 34, the roller 64 is pivotable with respect to the handle 34.

The operating linkage 36 can be said to include a contact arm 66 having a pair of bosses 68, only one of which is depicted herein for reasons of clarity, that are pivotably situated in holes formed in the plates 12 and that enable the contact arm 66 to be pivotably situated on the housing 6. The movable contact 30 is situated on the contact arm 66. The operating linkage 36 further includes a first link 70 that is pivotably connected with the contact arm 66, a second link 72 that is pivotably connected with the first link 70, and a latch link 76 that is pivotably connected with the second link 72. The first and second links 70 and 72 are pivotably connected with one another at a pivotable connection 78 with which the spring 40 is connected. The latch link 76 includes a pair of bosses 80, only one of which is depicted in FIG. 5, that are received in corresponding holes formed in corresponding plates 12 to enable the latch link 76 to be pivotably situated on the housing 6. The operating linkage 36 can must be said to form a five-bar linkage that includes the contact arm 66, the first link 70, the second link 72, the latch link 76, and the housing 6 itself.

The latch link 76 can be said to include a tip 82 that is biased into engagement with the latch surface 24 when the mechanism 10 is in the OFF position, and the tip 82 is likewise biased into engagement with the latch surface 24 when the mechanism 10 is in the ON position. Such biased engagement of the tip 82 with the latch surface 24 occurs when the latch 18 is in its first position, as is depicted generally in FIGS. 1-2 and 5.

When the handle 34 is rotated in a handle rotation direction 88 as is depicted in FIGS. 1 and 2 to move the mechanism 10 from the OFF position to the ON position, the spring 40 that extends between the tang 54 of the handle 34 and the pivotable connection 78 of the operating linkage 36 ultimately causes the contact arm 66 to rotate in a contact arm rotation direction 90. It is noted that the handle rotation direction 88 and the contact arm rotation direction 90 are generally opposite one another.

When the handle 34 is initially moved from the OFF position of FIG. 1 toward the ON position of FIG. 2, tension in the spring 40 increases due to stretching of the spring 40 while the operating linkage 36 remains substantially stationary. That is, when the mechanism 10 is in the OFF position depicted generally in FIG. 1, and when the handle 34 is initially rotated away from the OFF position in the handle rotation direction 88, the tip 82 of the latch link 76 remains biased into engagement with the latch surface 24 of the latch 18. Thus, even though the handle 34 has been rotated in the handle rotation direction 88 with respect to the housing 6, the operating linkage 36 initially remains in the same position as is depicted generally in FIG. 1 as the spring 40 is stretched and its tension and potential energy increase. However, once a central axis 92 of the spring 40 passes the toggle point 42, the tension in the spring 40 causes the operating linkage 36 to rapidly change states from the state depicted generally in FIG. 1 to the state depicted generally in FIG. 2. That is, such movement rapidly moves the set of separable contacts 32 from the OPEN position of FIG. 1 to the CLOSED position of FIG. 2. FIG. 2 depicts the central axis 92 of the spring 40 being situated at a first side 94 of the toggle point 42, it being understood that the first side 94 is downward direction from the toggle point 42 from the perspective of FIG. 2. In such a situation, the spring 40 continues to bias the tip 82 of the latch link 76 into engagement with the latch surface 24 of the latch 18, and the spring 40 also biases the movable contact 30 into engagement with the stationary contact 28, which is the CLOSED position of the set of separable contacts 32. The mechanism 10 remains in the ON position while the latch 18 remains in its first position.

However, if the latch 18 is rotated by the shaft 22 away from the first position of FIGS. 1-2 and 5, the latch surface 24 and the tip 82 are caused to become disengaged from one another, which is depicted generally in FIGS. 3-4 and 6-7. Since the spring 40 had biased the tip 82 into engagement with the latch surface 24, such bias imparted by the spring 40 to the tip 82 with the latch 18 in its second position causes the latch link 76 to rotate about its bosses 80 in the counter-clockwise direction from the perspective of FIG. 4, which moves the central axis 92 of the spring across the toggle point 42 and to a second side 98 of the toggle point 42 which is depicted as being above the toggle point 42 from the perspective of FIG. 4. The movement of the central axis 92 of the spring 40 from the first side 94 of the toggle point 42 to the second side 98 of the toggle point 42 causes the spring 40 to rapidly move the contact arm 66 in the counter-clockwise direction from the perspective of FIG. 4 and to therefore rapidly move the set of separable contacts 32 from the CLOSED position of FIG. 2 toward the OPEN position of FIG. 3. It is noted that FIG. 4 depicts an intermediate position of the mechanism 10 after the spring 40 has crossed from the first side 94 to the second side 98 of the toggle point 42 but before the mechanism 10 has fully reached its TRIP position of FIG. 3.

It thus can be seen that by operatively connecting together the handle 34 and the operating linkage 36 with the use of the spring 40 that extends therebetween, the positions, velocities, and accelerations of the handle 34 and those of the operating linkage 36 are independent of one another. This enables the operating linkage 36 to rapidly move the set of separable contacts 32 between the OPEN and CLOSED positions without additionally having to move the handle 34 at the same velocity and acceleration. This reduces inertia in the mechanism 10 and promotes more rapid functioning of the operating linkage 36 than would be possible if the handle 34 and the operating linkage 36 were connected by some type of cam mechanism or other rigid mechanism, by way of example. All of this is advantageous because it enables more rapid and efficient functioning of the circuit interrupter 4 among the OFF, ON, and TRIP positions. Moreover, since the handle 34 is used to increase the state of tension in the spring 40 when initially moving from the OFF position to the ON position, the rotational force applied to the handle 34 in moving the handle 34 in the handle rotation direction 88 needs to be applied to the handle 34 only until the point at which the central axis 92 of the spring 40 passes from the second side 98 of the toggle point 42 across the toggle point 42 to the first side 94 of the toggle point 94, at which point the tension in the spring 40 rapidly moves the operating linkage 36 to move the set of separable contacts 32 from the OPEN position to the CLOSED position. This advantageously reduces the effort needed to move the circuit interrupter 4 from the OFF position to the ON position by requiring force to be applied to the handle 34 only during an initial portion of the travel of the handle 34 in the handle rotation direction 88. It is reiterated that providing the mechanism 10 with the toggle point 42 which causes the operating linkage 36 to change states whenever the spring 40 passes between the first and second sides 94 and 98 of the toggle point 42 enables these advantages and others.

Figure 7:
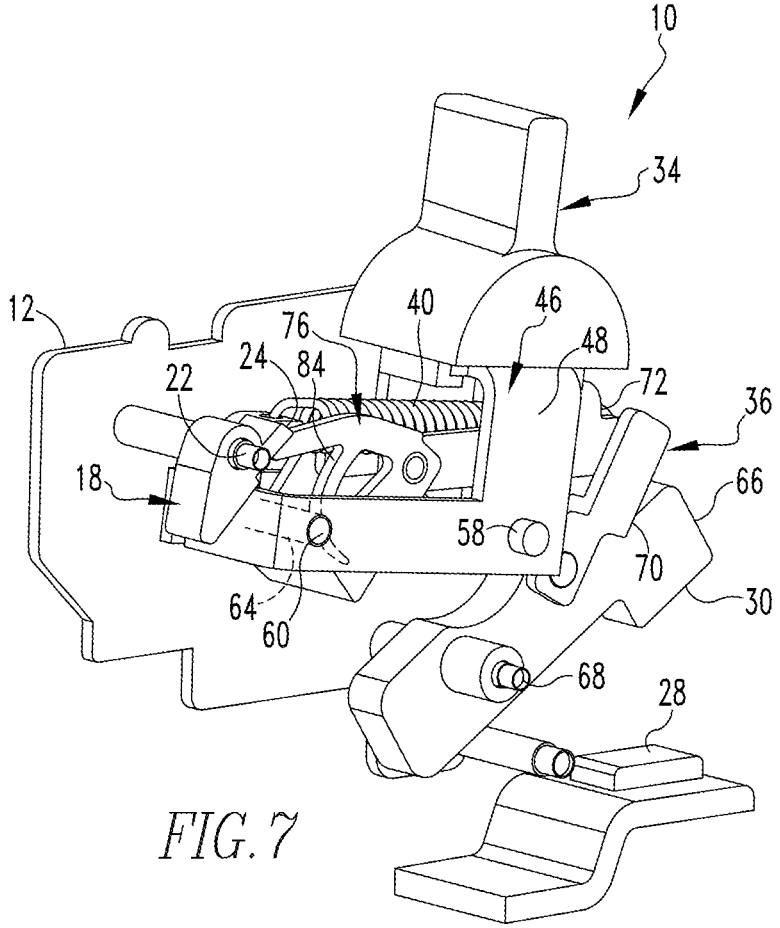
FIG. 7 is a view similar to FIG. 6, except depicting the mechanism during a resetting operation when the mechanism is being moved from the TRIP position toward the OFF position and wherein a roller of the mechanism rollably engages a surface of a latch link of the mechanism to move the mechanism toward the OFF position.

Further advantageously, the latch link 76 is provided with a reaction surface 84 that is engaged by the roller 64 when the mechanism 10 is moved from the TRIP position of FIG. 3 to the OFF position of FIG. 1. This is illustrated, for example, in FIG. 7. That is, when the mechanism 10 is moved from the TRIP position of FIGS. 3 and 6 toward the OFF position of FIG. 1, the roller 64 as is depicted in FIG. 7 rotatably engages the reaction surface 84 as the handle 34 is being rotated in a direction opposite the handle rotation direction 88. This returns the operating linkage 36 to the point at which the tip 82, which had been situated adjacent an underside 96 of the latch 18 in the TRIP position, to a point at which the tip 82 clears the underside 96 of the latch 18 and permits the tip 82 to again become engaged with the latch surface 24, as is depicted generally in FIG. 5, through bias of the spring 40. By providing rollable engagement between the roller 64 and the reaction surface 84, instead of conventional sliding frictional engagement therebetween, this advantageously reduces the force required to be applied to the handle 34 to move the mechanism 10 from the TRIP position to the OFF position.

It thus can be seen that by providing the mechanism 10 with the spring 40 operatively connecting the handle 34 and the operating linkage 36 together and changing states of the mechanism 10 when the spring 40 passes the toggle point 42, the mechanism 10 has improved performance which improves reliability of the circuit interrupter 4 and reduces the effort required to manually move the handle 34 among the various positions of the mechanism 10. Furthermore, by providing the roller 64 to rollably engage the reaction surface 84 of the latch link 76, the effort required to reset the mechanism 10 from the TRIP position to the OFF position is advantageously reduced. Other advantages will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A circuit interrupter comprising:

a housing;

a stationary contact situated on the housing;

a movable contact;

a mechanism comprising a handle, an operating linkage, and a spring, the mechanism being movable among an OFF position, an ON position, and a TRIP position;

the handle being situated on the housing and being pivotable with respect to the housing when the mechanism is moved among the OFF position, the ON position, and the TRIP position;

the operating linkage being situated on the housing and comprising a contact arm, the movable contact being disposed on the contact arm, the contact arm being pivotable with respect to the housing between a CLOSED position wherein the stationary contact and the movable contact are engaged with one another and an OPEN position wherein the stationary contact and the movable contact are spaced from one another; and the spring extending between the handle and the operating linkage, the spring being structured to bias the contact arm from the OPEN position to the CLOSED position when the mechanism moves from the OFF position to the ON position; and wherein the handle and the contact arm pivot in rotation directions that are generally opposite one another when the mechanism moves from the OFF position to the ON position.

2. The circuit interrupter of claim 1 wherein the spring is structured to bias the contact arm from the CLOSED position to the OPEN position when the mechanism moves from the ON position to at least one of the TRIP position and the OFF position.

3. The circuit interrupter of claim 1 wherein the handle and the contact arm pivot in opposite rotation directions with respect to the housing when the mechanism moves from the OFF position to the ON position.

4. The circuit interrupter of claim 1 wherein the mechanism further comprises a latch that is movable between a first position and a second position, the latch having a latch surface, the spring being structured to bias the operating linkage in the ON position into engagement with the latch surface in the first position, the spring being structured to bias the contact arm from the CLOSED position to the OPEN position when the latch moves from the first position to the second position.

5. The circuit interrupter of claim 4 wherein the operating linkage is disengaged from the latch surface in the second position.

6. The circuit interrupter of claim 5 wherein the mechanism has a toggle point about which the handle is pivotable when the mechanism is moved among the OFF position, the ON position, and the TRIP position, the spring being situated at a first side of the toggle point in the ON position, the spring being situated at a second side of the toggle point after the operating linkage has become disengaged from the latch surface in the second position.

7. The circuit interrupter of claim 6 wherein the operating linkage further comprises a latch link that is pivotable with respect to the housing when the mechanism is moved among the OFF position, the ON position, and the TRIP position, the spring being structured to bias the latch link in the ON position into engagement with the latch surface in the first position.

8. The circuit interrupter of claim 7 wherein the operating linkage further comprises a number of additional links that are interposed between the contact arm and the latch link.

9. The circuit interrupter of claim 8 wherein the number of additional links comprise a first link pivotably connected with the contact arm and a second link pivotably connected with the latch link.

10. The circuit interrupter of claim 9 wherein the operating linkage further comprises a pivotable connection at which the first link and the second link are pivotably connected with one another.

11. The circuit interrupter of claim 10 wherein the spring extends between the handle and the pivotable connection.

12. The circuit interrupter of claim 11 wherein the spring is a tension spring.

13. The circuit interrupter of claim 5 wherein the operating linkage further comprises a latch link that is pivotable with respect to the housing when the mechanism is moved among the OFF position, the ON position, and the TRIP position, the spring being structured to bias the latch link in the ON position into engagement with the latch surface in the first position, the handle being engaged with the latch link and moving the latch link into engagement with the latch surface in the first position when the handle is pivoted from the TRIP position to the OFF position.

14. A circuit interrupter comprising:

a housing;

a stationary contact situated on the housing;

a movable contact;

a mechanism comprising a handle, an operating linkage, and a spring, the mechanism being movable among an OFF position, an ON position, and a TRIP position;

the handle being situated on the housing and being pivotable with respect to the housing when the mechanism is moved among the OFF position, the ON position, and the TRIP position;

the operating linkage being situated on the housing and comprising a contact arm, the movable contact being disposed on the contact arm, the contact arm being pivotable with respect to the housing between a CLOSED position wherein the stationary contact and the movable contact are engaged with one another and an OPEN position wherein the stationary contact and the movable contact are spaced from one another;

the spring extending between the handle and the operating linkage, the spring being structured to bias the contact arm from the OPEN position to the CLOSED position when the mechanism moves from the OFF position to the ON position;

wherein the mechanism further comprises a latch that is movable between a first position and a second position, the latch having a latch surface, the spring being structured to bias the operating linkage in the ON position into engagement with the latch surface in the first position, the spring being structured to bias the contact arm from the CLOSED position to the OPEN position when the latch moves from the first position to the second position;

wherein the operating linkage is disengaged from the latch surface in the second position; and wherein the operating linkage further comprises a latch link and a roller, the latch link being pivotable with respect to the housing when the mechanism is moved among the OFF position, the ON position, and the TRIP position, the spring being structured to bias the latch link in the ON position into engagement with the latch surface in the first position, the roller being rollably engaged with the latch link and moving the latch link into engagement with the latch surface in the first position when the operating linkage is moved from the TRIP position to the OFF position.

15. The circuit interrupter of claim 14 wherein the handle comprises a base and a support, the support being situated on the base, the roller being rollably situated on the support.

16. The circuit interrupter of claim 15 wherein the base comprises a first portion and a second portion, the support extending between the first and second portions.

17. The circuit interrupter of claim 16 wherein the roller is situated between the first and second portions.

18. The circuit interrupter of claim 14 wherein the operating linkage further comprises a number of additional links that are interposed between the contact arm and the latch link.

19. The circuit interrupter of claim 18 wherein the number of additional links comprise a first link pivotably connected with the contact arm and a second link pivotably connected with the latch link, the operating linkage further comprising a pivotable connection at which the first link and the second link are pivotably connected with one another.

20. The circuit interrupter of claim 19 wherein the spring extends between the handle and the pivotable connection.

* * * * *